US011482093B1

(12) United States Patent
Reichert, Jr.

(10) Patent No.: US 11,482,093 B1
(45) Date of Patent: Oct. 25, 2022

(54) SYSTEMS AND METHODS FOR AUTOMATICALLY DETERMINING COMPLIANT OPERATION OF A POWER SUPPLY PANEL INTEGRATED IN A FIRE ALARM SYSTEM DESIGN

(71) Applicant: Great Southwestern Fire & Safety, Inc., Dallas, TX (US)

(72) Inventor: Eugene R. Reichert, Jr., Fort Worth, TX (US)

(73) Assignee: GREAT SOUTHWESTERN FIRE & SAFETY, INC., Dallas, TX (US)

( * ) Notice: Subject to any disclaimer, the term of this patent is extended or adjusted under 35 U.S.C. 154(b) by 0 days.

(21) Appl. No.: 17/362,106

(22) Filed: Jun. 29, 2021

(51) Int. Cl.
*G08B 29/18* (2006.01)
*G08B 17/00* (2006.01)

(52) U.S. Cl.
CPC ..... *G08B 29/18* (2013.01); *G08B 17/00* (2013.01)

(58) Field of Classification Search
CPC ..... G08B 29/18; G08B 17/00
See application file for complete search history.

(56) References Cited

U.S. PATENT DOCUMENTS 4,891,743 A * 1/1990 May ..... G01R 31/40 702/62
5,320,138 A * 6/1994 Ferlitch, Jr. ..... A62C 37/50 239/DIG. 15
5,950,150 A * 9/1999 Lloyd ..... A62C 37/50 714/809
6,459,175 B1 * 10/2002 Potega ..... H02J 7/00047 307/132 M
6,861,951 B2 * 3/2005 Reghetti ..... G08B 29/18 340/506
7,149,701 B2 * 12/2006 McKinney ..... G06Q 10/06 705/7.15
7,693,608 B2 * 4/2010 Nasle ..... G05B 23/0272 706/14
8,571,904 B2 * 10/2013 Guru ..... G06Q 50/04 705/7.11
11,062,593 B2 * 7/2021 Oliver ..... G08B 25/003

* cited by examiner

*Primary Examiner* — John A Tweel, Jr.
(74) *Attorney, Agent, or Firm* — Baker Botts, LLP

(57) ABSTRACT

The present disclosure is directed to systems and methods for automatically determining compliant operation of a power supply panel integrated in a fire alarm system, the method including the steps of receiving a first input in a first selectable field relating to a manufacturer type of the fire alarm system; receiving a second input in a second selectable field relating to a circuit class associated with circuits of the fire alarm system; receiving a third input in a third selectable field relating to an end-of-line resistor size; receiving one or more additional inputs relating to at least one of the power supply panel or the fire alarm system; and performing one or more calculations based on the first, second, and third inputs and the one or more additional inputs to generate outputs for determining compliant operation of the power supply panel integrated in the fire alarm system.

20 Claims, 2 Drawing Sheets

| | | | |
|---|---|---|---|
| Project Name: | | Prepared By: | |
| Project #: | | | |
| Project Address: | | Date: | |

| | | | | | | | | | |
|---|---|---|---|---|---|---|---|---|---|
| Battery Calculations for: | NOTIFIER PSE (105) | Power Supply: | | 115 | A/V TYPE | WHEELOCK | | | |
| Power Supply Location: | | | | 120 | CIRCUIT CLASS | A | RESISTOR SIZE (125) | 2KΩ | |
| 110 Max Total Current For Power Circuits (Amps): | | 6 | | 130 | Mode | Master | | | |
| 112 80% MAX USAGE (Amps) = | 4.8 | | | | | | | | |
| 114 Output Circuit Surplus % = | 20 | | | | | | | | |

| 135 Device | Part # (140) | Candela (145) | Total Current Standby (152) | Total Current Alarm (154) | Circuits (155) 1 NAC | 2 NAC | 3 NAC | 4 AUX | N/A | N/A | 5 TRIG | Total Current Standby (162) | Total Current Alarm (164) |
|---|---|---|---|---|---|---|---|---|---|---|---|---|---|
| Speaker Strobe (Ceiling) | LSPSTWC3 | 15cd | 0.000 | 0.040 | 1 | | 1 | | 1 | | | 0.000 | 0.120 |
| Speaker Strobe (Wall) | LSPSTW | 15cd | 0.000 | 0.030 | 1 | | 1 | | 1 | | | 0.000 | 0.090 |
| Strobe (Ceiling) | LSTWC3 | 15cd | 0.000 | 0.040 | 1 | | 1 | | 1 | | | 0.000 | 0.120 |
| Strobe (Wall) | LST3 | 15cd | 0.000 | 0.030 | 1 | | 1 | | 1 | | | 0.000 | 0.090 |
| WP Speaker Strobe (Ceiling) | 0 | 15cd | 0.000 | 0.030 | 1 | | 1 | | 1 | | | 0.000 | 0.090 |
| RELAY-Conv. Form C | PAM-1 | N/A | 0.050 | 0.000 | 1 | | 1 | | 1 | | | 0.150 | 0.000 |
| 136 Class A board Current draw | Installed | | 0.183 | 0.154 | | | | | | | | 0.183 | 0.154 |
| Register draw change | 2KΩ | | 0.231 | 0.208 | | | | | | | | 0.231 | 0.208 |

| 165 | |
|---|---|
| Starting Voltage: | 20.4 |
| Wire Guage: | 14 Solid |
| Resistance (Ohms) | 3.07 |
| Total Wire Length (ft): | 360 |
| A/C Branch Required: | 5A |

| 170 | | | | | | | | |
|---|---|---|---|---|---|---|---|---|
| 171 | Stand-by Draw Per Circuit | 0.150 | 0.000 | 0.150 | 0.000 | 0.150 | 0.000 | 0.000 |
| 172 | Alarm Draw Per Circuit | 0.170 | 0.000 | 0.170 | 0.000 | 0.170 | 0.000 | 0.000 |
| 173 | Olstance of Wire (ft) | 120 | 0 | 120 | 0 | 120 | 0 | 0 |
| 174 | Voltage Drop Per Circuit | 0.162 | 0.000 | 0.162 | 0.000 | 0.162 | 0.000 | 0.000 |
| 175 | End of Line Voltage | 20.24 | 20.40 | 20.24 | 20.40 | 20.24 | 20.40 | 20.40 |
| 176 | % of Voltage Drop | 1% | 0% | 1% | 0% | 1% | 0% | 0% |
| 177 | Status of Circuit | 1 | 1 | 1 | 1 | 1 | 1 | 1 |

| 180 | | | | | |
|---|---|---|---|---|---|
| 181 | SECONDARY STANDBY LOAD | | | 0.564 | |
| | REQUIRED STANDBY TIME (HRS) | | | 24 | |
| | TOTAL STANDBY AMP HOURS | | | 13.536 | |
| 182 | SECONDARY ALARM LOAD | | | | 0.872 |
| | REQUIRED ALARM TIME (MINS) | | | | 15 |
| | TOTAL ALARM AMP HOURS | | | | 0.218 |
| | DERATING FACTOR | | | 1.2 | |
| 183 | TOTAL SECONDARY LOAD | | | 13.75 | |
| 184 | SECONDARY LOAD REQ'D. (AH) | | | 16.5 | |
| 185 | BATTERIES PROVIDED (AH) | | | 7 | |

| 190 | | | | | | | | |
|---|---|---|---|---|---|---|---|---|
| Device Wire | Max Deivces | | Total Deivces | | | | | |
| 20 | 50 | | 18 | | | | | |
| IN (FEET) | 6 | 0 | 6 | 0 | 6 | 0 | 0 | Devices |
| | 120 | 0 | 120 | 0 | 120 | 0 | 0 | Device Wire |
| | | | | | | | | Circuit Length |

100

*FIG. 1*

SYSTEMS AND METHODS FOR AUTOMATICALLY DETERMINING COMPLIANT OPERATION OF A POWER SUPPLY PANEL INTEGRATED IN A FIRE ALARM SYSTEM DESIGN

TECHNICAL FIELD

The present disclosure generally relates to power supply panels, and more specifically, to systems and methods for automatically determining compliant operation of a power supply panel integrated in a fire alarm system design.

BACKGROUND

Fire alarm systems may comprise a plurality of components, circuits, and devices, including, by way of example, detectors, alarms, suppression systems, and monitoring stations, and the like. Power supply panels are integrated with fire alarm systems, and may serve to relay fire detection and response communications between the components, circuits and devices of the fire alarm systems.

BRIEF DESCRIPTION OF THE DRAWINGS

FIG. 1 illustrates a system for automatically determining compliant operation of a power supply panel integrated in a fire alarm system design, in accordance with certain embodiments;

DESCRIPTION OF EXAMPLE EMBODIMENTS

Overview

Figure 2:
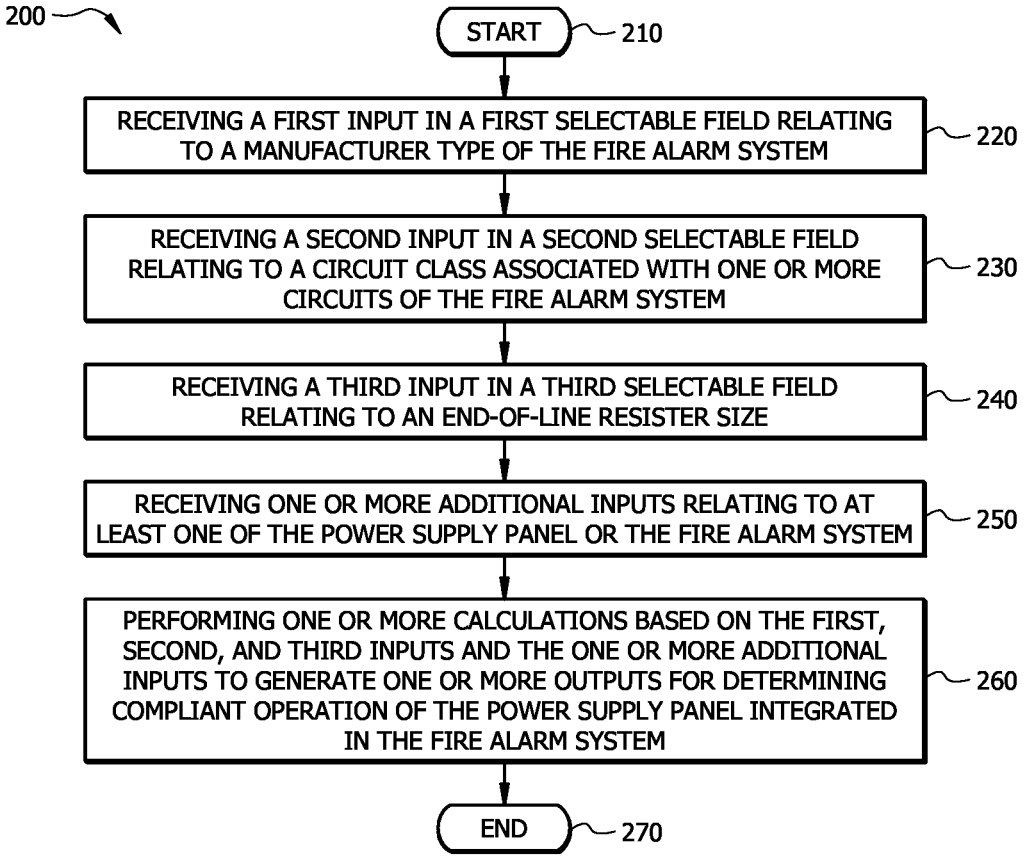
FIG. 2 illustrates a flow diagram of a method for automatically determining compliant operation of a power supply panel integrated in a fire alarm system design, in accordance with certain embodiments.

According to an embodiment, a method for determining compliant integration of a power supply panel in a fire alarm system may include, receiving a first input in a first selectable field relating to a manufacturer type of the fire alarm system; receiving a second input in a second selectable field relating to a circuit class associated with the one or more circuits of the fire alarm system; receiving a third input in a third selectable field relating to an end-of-line resistor size; receiving one or more additional inputs relating to at least one of the power supply panel or the fire alarm system; and performing one or more calculations based on the first, second, and third inputs and the one or more additional inputs to generate one or more outputs for determining compliant operation of the power supply panel integrated in the fire alarm system.

Moreover, the first, second, and third inputs and the one or more additional inputs may be received in a programmable calculation sheet. The programmable calculation sheet may include mathematical formulas for performing the one or more calculations.

Additionally, the one or more additional inputs may comprise a fourth input in a fourth selectable field relating to a mode of the power supply panel. Moreover, the one or more additional inputs may comprise a fifth input in a fifth selectable field relating to a maximum total current flow associated with the power supply panel. The fifth input of the fifth selectable field may generate a maximum total current output of the one or more outputs.

Furthermore, the one or more additional inputs may comprise a sixth input in a sixth selectable field related to one or more device types associated with the fire alarm system. Additionally, the one or more additional inputs may also comprise a seventh set of inputs in a seventh selectable field related to one or more output circuits of the fire alarm system. The one or more circuit types of the fire alarm system may comprise one or more of the following: one or more notification appliance circuits; one or more auxiliary circuits; or one or more trigger circuits.

Furthermore, the one or more outputs may comprise a total current draw value associated with the one or more output circuits of the fire alarm system. Also, the one or more outputs may comprise a voltage drop value associated with the one or more output circuits of the fire alarm system. Moreover, the one or more outputs may comprise a compliance status associated with the one or more output circuits of the fire alarm system. Additionally, the one or more outputs may be associated with a standby capacity of the fire alarm system. The standby capacity may be used to calculate a total standby power of the fire alarm system.

Moreover, the one or more outputs may be associated with an alarm capacity of the fire alarm system. The alarm capacity may be used to calculate a total alarm power of the fire alarm system.

Further, the one or more outputs may be associated with a minimum battery size required to maintain code compliance. Also, the one or more outputs may be associated with a maximum number of devices permitted for integration into the fire alarm system.

According to another embodiment, a system for determining compliant integration of a power supply panel in a fire alarm system may include one or more processors and one or more computer-readable non-transitory storage media comprising instructions that, when executed by the one or more processors, cause one or more components of the system to perform operations including, receiving a first input in a first selectable field relating to a manufacturer type of the fire alarm system; receiving a second input in a second selectable field relating to a circuit class associated with the one or more circuits of the fire alarm system; receiving a third input in a third selectable field relating to an end-of-line resistor size; receiving one or more additional inputs relating to at least one of the power supply panel or the fire alarm system; and performing one or more calculations based on the first, second, and third inputs and the one or more additional inputs to generate one or more outputs for determining compliant operation of the power supply panel integrated in the fire alarm system.

According to yet another embodiment, one or more computer-readable non-transitory storage media embodying instructions that, when executed by a processor, cause the performance of operations including receiving a first input in a first selectable field relating to a manufacturer type of the fire alarm system; receiving a second input in a second selectable field relating to a circuit class associated with the one or more circuits of the fire alarm system; receiving a third input in a third selectable field relating to an end-of-line resistor size; receiving one or more additional inputs relating to at least one of the power supply panel or the fire alarm system; and performing one or more calculations based on the first, second, and third inputs and the one or more additional inputs to generate one or more outputs for determining compliant operation of the power supply panel integrated in the fire alarm system.

Technical advantages of certain embodiments of this disclosure may include one or more of the following. The systems and methods described herein may allow for designer or engineer to automatically determine whether the design parameters associated with a power supply panel integrated into a fire alarm system is in compliance with safety protocols and design specifications. The systems and methods of the present disclosure may also provide mechanisms for identifying problematic aspects of the integration and/or design.

Other technical advantages will be readily apparent to one skilled in the art from the following figures, descriptions, and claims. Moreover, while specific advantages have been enumerated above, various embodiments may include all, some, or none of the enumerated advantages.

EXAMPLE EMBODIMENTS

A power supply panel generally comprises, inter alia, a main circuit board comprising, e.g., a microprocessor, a power supply, primary components, and wiring connections; a battery for short-term power supply in the event of a main power supply interruption; one or more notification appliance circuits (NACs) for initiating auditory and visual alarms; a power conditioner for protecting the power supply panel from electrical surges, spikes, sags, over-voltages, brownouts, and electrical noise; and one or more signaling line circuit (SLC) loops for providing communication to addressable input and output alarm appliances. When designing a fire alarm system having a plurality of components, e.g., detectors, alarms, suppression systems, etc., there are many considerations impacting the design, particularly as it relates to the given power supply panel to be used in conjunction with the fire alarm system. For example, among other things, the load on the system, the maximum current draw per circuit, and the voltage draw per circuit must all fall within a safe range in order to ensure compliance with National Fire Alarm and Signaling codes of the National Fire Protection Association (NFPA).

The present disclosure is directed to systems and methods for automatically determining compliant operation of a power supply panel integrated in a given alarm system design. More specifically, the present disclosure provides systems and methods that may allow a designer or engineer of fire alarm systems to automatically and/or instantaneously determine whether a given power supply panel, as integrated into a fire alarm system (i.e., joined with the other circuits, components, and devices of the fire alarm system), will operate in compliance with pre-determined safety and operation parameters. The systems and methods of the present disclosure may also provide mechanisms for identifying problematic aspects of the integration and/or design.

Reference is now made to FIG. 1, wherein is shown a system, as embodied in an example calculation sheet 100, for automatically determining compliant operation of a particular power supply panel integrated in a given fire alarm system design, wherein the fire alarm system design may comprise any number of devices, components, circuits, etc. In an embodiment, the calculation sheet 100 may comprise a programmable calculation sheet, e.g., programmed with mathematical formulas for performing an array of calculations. Based on a plurality of inputs received, the calculation sheet may perform one or more calculations to generate one or more outputs. The outputs may be used to determine compliance of the overall integration of the power supply panel and the fire alarm system, as well as compliance of specific circuits of the fire alarm system. In an embodiment, the functions and/or the calculations performed by the calculation sheet 100 may be programmed as mathematical formulas, using tables, and/or with Visual Basic programming instructions into a Microsoft Excel spreadsheet. In other embodiments, the functions and or calculations performed by the calculation sheet 100 may be programmed using instructions associated with other programming languages known in the art.

As shown in FIG. 1, the calculation sheet 100 may include a plurality of selectable fields configured for selecting specific parameters (i.e., input data) of a fire alarm system design and the power supply panel 105 to be used with the fire alarm system. Based on the parameters or inputs provided in the plurality of selectable fields, the calculation sheet 100 may automatically generate a set of output results indicating, for example, the status of each circuit (e.g., pass or fail) of the fire alarm system, current draw per circuit, voltage drop per circuit, the end of line voltage for each circuit, and other factors to determine compliant operation of the fire alarm system design having the integrated power supply panel.

With continued reference to FIG. 1, a first selectable field 115 (referred to in FIG. 1 as "A/V Type") of the calculation sheet 100 may allow a user to select and/or enter an input relating to a manufacturer type of the fire alarm system. In an embodiment, a plurality of selections may be available for selection in the first selectable field 115. By way of example and not limitation, the plurality of selections in the first selectable field 115 may include manufacturer names such as Wheelock®, System Sensor®, Gentex®, Potter®, and/or any other fire alarm system manufacturer known in the art. Because fire alarm device specifications vary based on manufacturer, selection of a manufacture type may allow for calculations that determine, e.g., the alarm current draw, etc. based on particular manufacturer specifications. Once a user selects a manufacturer type in the first selectable field 115, the calculation sheet 100 receives an input (referred to hereafter as the "first input") related to the first selectable field 115, and the calculation sheet may factor the requirements of a the selected manufacturer when calculating and outputting the values for determining compliant operation of the fire alarm system.

A second selectable field 120 (referred to in FIG. 1 as "Circuit Class") of the calculation sheet 100 may allow a user to select and/or enter an input relating to a circuit class, which refers to the circuit type (e.g., Class A or Class B) of the fire alarm system. A "Class A" circuit refers to an alarm circuit employing a single continuous two-wire path from the power supply panel to a first device, running through to a last device, and returning to the panel supply panel via a separate entry point. A "Class B" circuit refers to an alarm circuit having a two-wire input or output circuit which terminates in an end-of-line resistor. Class A circuits require an additional circuit board and circuit draw. Thus, if a user selects Class A in the second selectable field 120, the calculation sheet 100 may automatically populate a related field 136 (referred to in FIG. 1 as "Class A board current draw") indicating the required addition of a Class A circuit board requiring additional current draw. Once a user selects a circuit class in the second selectable field 120, the calculation sheet 100 receives an input (referred to hereafter as the "second input") relating to the second selectable field 120.

A third selectable field 125 (referred to in FIG. 1 as "Resistor Size") of the calculation sheet 100 may allow a user to select and/or enter an input relating to the resistor size of the end-of-line resistor on each output circuit of the fire alarm system. In an embodiment, the third selectable field 125 may comprise a drop-down list comprising a plurality of selections. For example, the selections in the third selectable field 125 may include a selection for a 2 KΩ resistor size and a selection for a 27 KΩ resistor size. Once a user selects a resistor size in the third selectable field 125, the calculation sheet 100 receives an input (referred to hereafter as the "third input") relating to the third selectable field 125, and the calculation sheet 100 may factor the end-of-line resistor size when calculating and outputting the values for determining compliant operation of the fire alarm system.

The calculation sheet 100 may further receive one or more additional inputs relating to at least one of the power supply panel and/or the devices of the fire alarm system. For example, a fourth selectable field 130 (referred to in FIG. 1 as "Mode") of the calculation sheet 100 may allow a user to select and/or enter an input relating to the mode of the power supply panel. In an embodiment, the fourth selectable field 130 may include a drop-down list comprising selections which may be selected by a user. For example, the selections may include a Master mode selection and a Slave mode selection. When the power supply panel is set to a Master mode, the power supply panel may supply all power to the fire alarm system. If the power supply panel is set to a Slave mode, the power supply panel may take over if the master circuit of the fire alarm system stops supplying power. Once a user selects a mode of the power supply panel in the fourth selectable field 130, the calculation sheet 100 receives an input (referred to hereafter as the "fourth input") relating to the fourth selectable field 130, and the calculation sheet 100 may factor the mode of the power supply panel when calculating and outputting the values for determining compliant operation of the fire alarm system.

The one or more additional inputs of the calculation sheet 100 may further be associated with a fifth selectable field 110 (referred to in FIG. 1 as "Max Total Current for Power Circuits"), which may allow a user to select and/or enter an input relating to a maximum total current flow for the power supply panel. In an embodiment, the fifth selectable field 110 may include a drop-down list comprising selections, including a 10 Amp selection and a 6 Amp selection, for selection by a user. Based on the selection in the fifth selectable field 110, a maximum usage field 112 (referred to in FIG. 1 as "80% Max Usage"), which is calculated based on the maximum total current used by the power supply panel, may be automatically updated. Additionally as known in the art, a 6 Amp power supply panel design may be associated with a maximum of five circuits, and a 10 Amp power supply panel design may be associated with a maximum of seven circuits. As such, the calculation sheet 100 may be programmed to receive inputs relating to a maximum of seven circuits (as discussed in detail below), and if the 6 Amp selection is made, two of seven circuits may be automatically removed (or shaded out) in the calculation sheet 100. Moreover, based on the selection of the fifth selectable field 110, an output current surplus field 114 (referred to in FIG. 1 as "Output Current Surplus %"), which indicates the desired voltage and current on the power supply panel circuit, may be updated. Once a user selects a maximum total current flow of the power supply panel in the fifth selectable field 110, the calculation sheet 100 may receive an input (referred to hereafter as the "fifth input") relating to the fifth selectable field 110.

The one or more additional inputs may further be associated with one or more devices of the fire alarm system. Specifically, the fire alarm system may comprise a plurality of devices, e.g., speaker strobes, horn strobes, sounder bases, door holders, carbon monoxide detectors, and the like, each capable of being mounted on a wall or ceiling and each having a different current draw. Thus, a sixth selectable field 135 (referred to in FIG. 1 as "Device") of the calculation sheet 100 may allow a user to select and/or enter an input relating to one or more device types. In an embodiment, the sixth selectable field 135 may include a drop down menu that is configured to allow a user to select any number and/or types of devices of the fire alarm system. In an embodiment, the calculation sheet 100 may be configured such that a plurality of devices may be selected or input in the sixth selectable field 135. Once a user selects a device type in the sixth selectable field 135, the calculation sheet 100 may receive an input (referred to hereafter as the "sixth input") relating to the sixth selectable field 135. Since a plurality of devices may be selected or input into the sixth selectable field 135, it is to be understood that the term "sixth input" may refer to one or more inputs in the sixth selectable field 135.

The one or more additional inputs may further be associated with one or more output circuits of the fire alarm system. Specifically, the fire alarm system may comprise output circuits, including one or more notification appliance circuits (NACs), one or more auxiliary circuits, and/or one or more trigger circuits. These output circuits may be connected to output points in the power supply panel, and the seventh selectable field 155 (referred to in FIG. 1 as "Circuits") of the calculation sheet 100 may allow a user to indicate the number of associated circuits for each category of output circuit (i.e., the number of associated circuits that comprise NACs, the number of associated circuits that comprise auxiliary circuits, and the number of associated circuits that comprise trigger circuits) in the fire alarm system. As noted above, 6 Amp power supply panel may be associated with up to five output circuits, and a 10 Amp power supply panel may be associated with up to seven output circuits. Thus, the selections entered into the fifth selectable field 110 may impact the number of output circuits that are listed in the seventh selectable field 155.

The one or more additional inputs may further be associated with any number, category, or type of additional inputs. By way of example, additional inputs may be associated with part numbers 140 (referred to in FIG. 1 as "Part #") of devices, candela 145 (the luminous intensity of a light source in a particular direction), and the like. Additional technical parameters 165 that may be programmed for input into the calculation sheet include the desired starting voltage of the power supply panel, the wire gauge, the resistance, whether an A/C branch is required, etc. It is to be understood that the present disclosure contemplates that the calculation sheet may be programmed to receive any number, type or category of inputs.

Based on any combination or number of inputs received (i.e., the inputs described above), the calculation sheet 100 may perform one or more calculations to generate one or more outputs for determining compliant operation of the integrated power supply panel and fire alarm system design. For example, the one or more outputs may include a "first total current draw" 150, which refers to the overall current draw of the power supply panel. The first total current draw may refer to a current draw that does not factor in the output circuits of the seventh selectable field 155. The first total current draw 150 may further include the total current draw in standby mode 152 and alarm mode 154. The one or more outputs may also include a "second total current draw" 160, which may refer to the overall current draw of the power supply panel which factors in the output circuits of the seventh selectable field 155. The second total current draw 160 may also include total current draw in standby mode 162 and alarm mode 164.

The one or more outputs may also include calculations specific to each output circuit selected in the seventh selectable field. For example, the one or more outputs may generally include current and voltage data 170. More specifically, current and voltage data 170 may include, e.g., a standby current draw 171 per output circuit, an alarm current draw 172 per output circuit, the distance of wire required 173 per output circuit, the voltage drop 174 per output circuit, an end-of-line voltage 175 per output circuit, a percent voltage drop 176 per output circuit, and an overall compliance status 177 per output circuit.

The one or more outputs may also include calculations relating to current and load data 180 of the power supply panel integrated with the fire alarm system. For example, the outputs relating to current and load data 180 may include metrics relating to standby capacity 181. Specifically, based on the inputs, the calculation sheet 100 may output standby capacity metrics associated with a secondary standby load. When a required standby time (hours) is provided, the calculation sheet 100 may also output the total standby power (measured in Amp Hours). The outputs relating to current and load data 180 may also include metrics relating to alarm capacity 182, such as a secondary alarm load. When a required alarm time (minutes) is provided, the calculation sheet may also output the total alarm power (measured in Amp Hours). Other outputs of the calculation sheet may include a total secondary load 183, a required secondary load 184, and the minimum battery size 185 required to meet code compliance.

The one or more outputs may also include calculations relating to device parameters 190. Device parameters 190 may include a maximum number of devices permitted for integration into the fire alarm system, as well as the total number of devices that have been input into the calculation sheet 100 by the user.

A designer or engineer of a fire alarm system may use the plurality of outputs generated by the calculation sheet 100 to determine whether a fire alarm system design integrating a particular power supply panel is compliant with safety codes, protocols, design parameters, and the like. The systems and methods of the present disclosure may also provide mechanisms for identifying problematic aspects of the integration and/or design. In an embodiment, the calculation sheet 100 may highlight (by color or design) any output values that fall outside a compliant range or that may result in a problematic overall design. Similarly, the calculation sheet 100 may highlight (by color or design) output values that fall within a compliant range. For example, output values that fall outside a compliant range may be shown in red, while out values that fall within a compliant range may be shown in green.

Reference is now made to FIG. 2, wherein is shown a flow diagram of a method 200 for automatically determining compliant operation of a power supply panel integrated in a fire alarm system design, in accordance with the present disclosure. The steps of the method 200 may be in accord with the operations outlined in conjunction with the calculation sheet 100 of FIG. 1. As such, similar and corresponding terms described in conjunction with FIG. 1 may have the same meaning when used in conjunction with the method 200 of FIG. 2. Additionally, the present disclosure incorporates by reference the description of FIG. 1 for the purposes of explaining, expounding upon, or otherwise clarifying the steps of the method 200.

The method 200 may be performed from the perspective of a programmable calculation sheet for performing an array of calculations. Based on a plurality of inputs received in the calculation sheet, the calculation sheet may perform one or more calculations to generate one or more outputs. The output values resulting from performance of the calculations may be used to determine compliance of the overall design of the fire alarm system having the integrated power supply panel, as well as compliance of one or more circuits of the fire alarm system when integrated with the power supply panel. In an embodiment, the functions of the calculation sheet may be programmed with formulas, using tables, and/or with Visual Basic programming instructions into a Microsoft Excel spreadsheet. In other embodiments, the functions of the calculation sheet may be programmed using instructions associated with other programming languages known in the art.

The method may begin at step 210. At step 220, a user may enter and the calculation sheet may receive a first input in a first selectable field relating to a manufacturer type of the fire alarm system. In an embodiment, a plurality of manufacturer selections may be available for selection in the first selectable field. Because fire alarm device specifications vary based on manufacturer, selection of a manufacture type may allow for calculations based on particular manufacturer specifications. Based on the first input, the calculation sheet may factor the particular requirements of a the selected manufacturer when calculating and outputting the values for determining compliant operation of the fire alarm system.

At step 230, the calculation sheet may receive a second input in a second selectable field relating to a circuit class associated with the fire alarm system. Circuit class may refer to a Class A or Class B circuit, as described above in conjunction with FIG. 1. If a user selects Class A, the calculation sheet may automatically populate a related field indicating the addition of a Class A circuit board requiring additional current draw. Based on the second input, the calculation sheet may automatically factor appropriate current draws for either Class A or Class B, as applicable, for the fire alarm system.

At step 240, the calculation sheet may receive a third input in a third selectable field relating to an end-of-line resistor size on each output circuit of the fire alarm system. In an embodiment, the selections in the third selectable field may include a selection for a 2 KΩ resistor size or a selection for a 27 KΩ resistor size. Based on the third input, the calculation sheet may factor the selected end-of-line resistor size when calculating and outputting the values for determining compliant operation of the fire alarm system.

At step 250, the calculation sheet may receiving receive one or more additional inputs relating to at least one of the power supply panel or the fire alarm system. For example, the calculation sheet may receive a fourth input in a fourth selectable field relating to the mode of the power supply panel. In an embodiment, the mode of the power supply panel may refer to a Master mode or a Slave mode. Specifically, when the power supply panel is set to a Master mode, the power supply panel may supply all power to the fire alarm system. If the power supply panel is set to a Slave mode, the power supply panel may take over if the master circuit of the fire alarm system stops supplying power. In another embodiment, other modes may be included for selection in the fourth selectable field. Based on the fourth input, the calculation sheet may factor the selected mode of the power supply panel, taking into account the appropriate current and voltage values associated with the selected mode, when calculating and outputting the values for determining compliant operation of the fire alarm system.

The one or more additional inputs may further be related to a maximum current flow desired for the power supply panel. A fifth selectable field of the calculation sheet may allow a user to select and/or enter a fifth input relating to a maximum total current flow for the power supply panel. In an embodiment, the selections in the fifth selectable field may include a 10 Amp selection and a 6 Amp selection. Based on the selection of the fifth selectable field, a maximum usage field, which is calculated based on the maximum total current used by the power supply panel, may be automatically updated. Additionally, a 6 Amp power supply panel design is associated with a maximum of five circuits, and a 10 Amp power supply panel design in associated with a maximum of seven circuits. As such, the calculation sheet may be programmed to receive inputs relating to a maximum of seven circuits; if the 6 Amp selection is made, two of seven circuits may be automatically removed (or shaded out) in the calculation sheet. Moreover, based on the selection of the fifth selectable field, an output current surplus field, which indicates the desired voltage and current on the power supply panel circuit, may be updated.

The one or more additional inputs may further be associated with one or more devices of the fire alarm system. Specifically, the fire alarm system may comprise a plurality of devices, e.g., speaker strobes, horn strobes, sounder bases, door holders, carbon monoxide detectors, and the like, each capable of being mounted on a wall or ceiling and each having a different current draw. Thus, a sixth selectable field of the calculation sheet may allow a user to select and/or enter a sixth input relating to one or more device types. In an embodiment, the sixth selectable field may include a drop down menu that is configured to allow a user to select any number and/or type of devices of the fire alarm system. In an embodiment, the calculation sheet may be configured such that a plurality of devices may be selected or input in the sixth selectable field. Since a plurality of devices may be selected or input into the sixth selectable field, it is to be understood that the term "sixth input" may refer to one or more inputs in the sixth selectable field.

The one or more additional inputs may further be associated with one or more output circuits of the fire alarm system. Specifically, the fire alarm system may comprise output circuits, including one or more notification appliance circuits (NACs), one or more auxiliary circuits, and/or one or more trigger circuits. These output circuits may be connected to output points in the power supply panel, and a seventh selectable field of the calculation sheet may allow a user to indicate the number of associated circuits for each category of output circuit (i.e., the number of associated circuits that comprise NACs, the number of associated circuits that comprise auxiliary circuits, and the number of associated circuits that comprise trigger circuits) in the fire alarm system. As noted above, 6 Amp power supply panel may be associated with up to five output circuits, and a 10 Amp power supply panel may be associated with up to seven output circuits. Thus, the selections entered into the fifth selectable field may impact the number of output circuits that are listed in the seventh selectable field.

The one or more additional inputs may further be associated with any number, category, or type of inputs. By way of example, additional inputs may be associated with part numbers of devices, candelas, and the like. Additional technical parameters that may be programmed for input into the calculation sheet include the desired starting voltage of the power supply panel, the wire gauge, the resistance, whether an A/C branch is required, etc. It is to be understood that the present disclosure contemplates that the calculation sheet may be programmed to receive any number, type or category of inputs.

At step 260, the calculation sheet may perform one or more calculations based on the first, second, and third inputs and the one or more additional inputs to generate one or more outputs for determining compliant operation of the power supply panel integrated in the fire alarm system. For example, the one or more outputs may include a first total current draw, which refers to the overall current draw of the power supply panel and does not factor in the output circuits of the seventh selectable field. The first total current draw may include total current draw in standby mode and alarm mode of the power supply panel. The one or more outputs may also include a second total current draw, which may refer to the overall current draw of the power supply panel and which may factor in the output circuits of the seventh selectable field. The second total current draw may include total current draw in standby mode and alarm mode of the power supply panel.

The one or more outputs may also include calculations specific to each output circuit selected in the seventh selectable field. For example, the one or more outputs may include current and voltage data, which may further include, e.g., a standby current draw per output circuit, an alarm current draw per output circuit, the distance of wire required per output circuit, the voltage drop per output circuit, the end-of-line voltage per output circuit, the percent voltage drop per output circuit, and the overall compliance status per output circuit.

The one or more outputs may also include calculations relating to current and load data of the power supply panel integrated with the fire alarm system. For example, the outputs relating to current and load data may include metrics relating to standby capacity. Specifically, based on the inputs, the calculation sheet may output standby capacity metrics such as secondary standby load. When a required standby time (hours) is provided, the calculation sheet may also output the total standby power (measured in Amp Hours). The outputs relating to current and load data may also include metrics relating to alarm capacity, including, e.g., a secondary alarm load. When a required alarm time (minutes) is provided, the calculation sheet may also output the total alarm power (measured in Amp Hours). Other outputs of the calculation sheet may include a total secondary load, a required secondary load, and the minimum battery size to meet code compliance.

The one or more outputs may also include calculations relating to device parameters. Device parameters may include a maximum number of devices permitted for integration into the fire alarm system, as well as the total number of devices that have been input into the calculation sheet by the user.

In sum, the present disclosure is directed to systems and methods that allow a designer or engineer to automatically determine whether the design parameters associated with a power supply panel integrated into a fire alarm system is in compliance, both operationally and regulatorily with the NFPA. The systems and methods of the present disclosure may also provide mechanisms for identifying problematic aspects of the integration and/or design. In an embodiment, the calculation sheet may highlight (by color or design) any output values that fall outside a compliant range or may result in a problematic overall design. Similarly, the calculation sheet may highlight (by color or design) output values that fall within a compliant range.

The systems and methods of the present disclosure further allow for efficient evaluation and determination of the compliance of fire alarm system designs. By simply inputting one or more parameters of a given fire alarm system and power supply panel integration, a user is able to automatically obtain, through the calculation sheet, the resulting data necessary to determine whether the design complies with safety codes, protocols, and/or desired design parameters. In some embodiments, the calculation sheet may also provide automatic alerts regarding output values that fall outside a compliant range, so that a designer or engineer may modify problematic aspects of a design accordingly.

Figure 3:
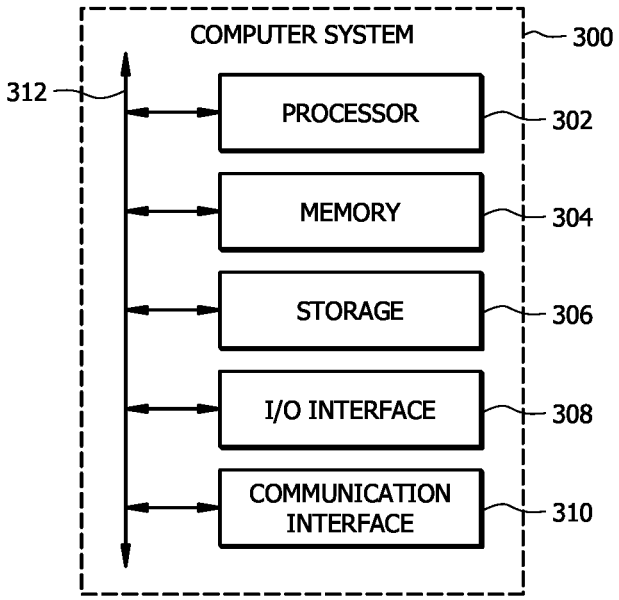
FIG. 3 illustrates a computer system, in accordance with certain embodiments.

Reference is now made to FIG. 3, wherein is shown an example computer system 300. In particular embodiments, one or more computer systems 300 perform one or more steps of one or more methods described or illustrated herein. In particular embodiments, one or more computer systems 300 provide functionality described or illustrated herein. In particular embodiments, software running on one or more computer systems 300 performs one or more steps of one or more methods described or illustrated herein or provides functionality described or illustrated herein. Particular embodiments include one or more portions of one or more computer systems 300. Herein, reference to a computer system may encompass a computing device, and vice versa, where appropriate. Moreover, reference to a computer system may encompass one or more computer systems, where appropriate.

This disclosure contemplates any suitable number of computer systems 300. This disclosure contemplates computer system 300 taking any suitable physical form. As example and not by way of limitation, computer system 300 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, computer system 300 may include one or more computer systems 300; be unitary or distributed; span multiple locations; span multiple machines; span multiple data centers; or reside in a cloud, which may include one or more cloud components in one or more networks. Where appropriate, one or more computer systems 300 may perform without substantial spatial or temporal limitation one or more steps of one or more methods described or illustrated herein. As an example and not by way of limitation, one or more computer systems 300 may perform in real time or in batch mode one or more steps of one or more methods described or illustrated herein. One or more computer systems 300 may perform at different times or at different locations one or more steps of one or more methods described or illustrated herein, where appropriate.

In particular embodiments, computer system 300 includes a processor 302, memory 304, storage 306, an input/output (I/O) interface 308, a communication interface 310, and a bus 312. Although this disclosure describes and illustrates a particular computer system having a particular number of particular components in a particular arrangement, this disclosure contemplates any suitable computer system having any suitable number of any suitable components in any suitable arrangement.

In particular embodiments, processor 302 includes hardware for executing instructions, such as those making up a computer program. As an example and not by way of limitation, to execute instructions, processor 302 may retrieve (or fetch) the instructions from an internal register, an internal cache, memory 304, or storage 306; decode and execute them; and then write one or more results to an internal register, an internal cache, memory 304, or storage 306. In particular embodiments, processor 302 may include one or more internal caches for data, instructions, or addresses. This disclosure contemplates processor 302 including any suitable number of any suitable internal caches, where appropriate. As an example and not by way of limitation, processor 302 may include one or more instruction caches, one or more data caches, and one or more translation lookaside buffers (TLBs). Instructions in the instruction caches may be copies of instructions in memory 304 or storage 306, and the instruction caches may speed up retrieval of those instructions by processor 302. Data in the data caches may be copies of data in memory 304 or storage 306 for instructions executing at processor 302 to operate on; the results of previous instructions executed at processor 302 for access by subsequent instructions executing at processor 302 or for writing to memory 304 or storage 306; or other suitable data. The data caches may speed up read or write operations by processor 302. The TLBs may speed up virtual-address translation for processor 302. In particular embodiments, processor 302 may include one or more internal registers for data, instructions, or addresses. This disclosure contemplates processor 302 including any suitable number of any suitable internal registers, where appropriate. Where appropriate, processor 302 may include one or more arithmetic logic units (ALUs); be a multi-core processor; or include one or more processors 302. Although this disclosure describes and illustrates a particular processor, this disclosure contemplates any suitable processor.

In particular embodiments, memory 304 includes main memory for storing instructions for processor 302 to execute or data for processor 302 to operate on. As an example and not by way of limitation, computer system 300 may load instructions from storage 306 or another source (such as, for example, another computer system 300) to memory 304. Processor 302 may then load the instructions from memory 304 to an internal register or internal cache. To execute the instructions, processor 302 may retrieve the instructions from the internal register or internal cache and decode them. During or after execution of the instructions, processor 302 may write one or more results (which may be intermediate or final results) to the internal register or internal cache. Processor 302 may then write one or more of those results to memory 304. In particular embodiments, processor 302 executes only instructions in one or more internal registers or internal caches or in memory 304 (as opposed to storage 306 or elsewhere) and operates only on data in one or more internal registers or internal caches or in memory 304 (as opposed to storage 306 or elsewhere). One or more memory buses (which may each include an address bus and a data bus) may couple processor 302 to memory 304. Bus 312 may include one or more memory buses, as described below. In particular embodiments, one or more memory management units (MMUs) reside between processor 302 and memory 304 and facilitate accesses to memory 304 requested by processor 302. In particular embodiments, memory 304 includes random access memory (RAM). This RAM may be volatile memory, where appropriate. Where appropriate, this RAM may be dynamic RAM (DRAM) or static RAM (SRAM). Moreover, where appropriate, this RAM may be single-ported or multi-ported RAM. This disclosure contemplates any suitable RAM. Memory 304 may include one or more memories 304, where appropriate. Although this disclosure describes and illustrates particular memory, this disclosure contemplates any suitable memory.

In particular embodiments, storage 306 includes mass storage for data or instructions. As an example and not by way of limitation, storage 306 may include a hard disk drive (HDD), a floppy disk drive, flash memory, an optical disc, a magneto-optical disc, magnetic tape, or a Universal Serial Bus (USB) drive or a combination of two or more of these. Storage 306 may include removable or non-removable (or fixed) media, where appropriate. Storage 306 may be internal or external to computer system 300, where appropriate. In particular embodiments, storage 306 is non-volatile, solid-state memory. In particular embodiments, storage 306 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 306 taking any suitable physical form. Storage 306 may include one or more storage control units facilitating communication between processor 302 and storage 306, where appropriate. Where appropriate, storage 306 may include one or more storages 306. Although this disclosure describes and illustrates particular storage, this disclosure contemplates any suitable storage.

In particular embodiments, I/O interface 308 includes hardware, software, or both, providing one or more interfaces for communication between computer system 300 and one or more I/O devices. Computer system 300 may include one or more of these I/O devices, where appropriate. One or more of these I/O devices may enable communication between a person and computer system 300. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 308 for them. Where appropriate, I/O interface 308 may include one or more device or software drivers enabling processor 302 to drive one or more of these I/O devices. I/O interface 308 may include one or more I/O interfaces 308, where appropriate. Although this disclosure describes and illustrates a particular I/O interface, this disclosure contemplates any suitable I/O interface.

In particular embodiments, communication interface 310 includes hardware, software, or both providing one or more interfaces for communication (such as, for example, packet-based communication) between computer system 300 and one or more other computer systems 300 or one or more networks. As an example and not by way of limitation, communication interface 310 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 310 for it. As an example and not by way of limitation, computer system 300 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 300 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network, a Long-Term Evolution (LTE) network, or a 5G network), or other suitable wireless network or a combination of two or more of these. Computer system 300 may include any suitable communication interface 310 for any of these networks, where appropriate. Communication interface 310 may include one or more communication interfaces 310, where appropriate. Although this disclosure describes and illustrates a particular communication interface, this disclosure contemplates any suitable communication interface.

In particular embodiments, bus 312 includes hardware, software, or both coupling components of computer system 300 to each other. As an example and not by way of limitation, bus 312 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 312 may include one or more buses 312, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

The embodiments disclosed herein are only examples, and the scope of this disclosure is not limited to them. Particular embodiments may include all, some, or none of the components, elements, features, functions, operations, or steps of the embodiments disclosed herein. Embodiments according to the disclosure are in particular disclosed in the attached claims directed to a method, a storage medium, a system and a computer program product, wherein any feature mentioned in one claim category, e.g. method, can be claimed in another claim category, e.g. system, as well. The dependencies or references back in the attached claims are chosen for formal reasons only. However, any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

What is claimed is:

1. A method for determining compliant integration of a power supply panel in a fire alarm system, comprising:

providing a user interface comprising a plurality of selectable fields;

receiving a first input in a first selectable field relating to a manufacturer type of the fire alarm system;

receiving a second input in a second selectable field relating to a circuit class associated with one or more circuits of the fire alarm system;

receiving a third input in a third selectable field relating to an end-of-line resistor size;

receiving one or more additional inputs relating to at least one of the power supply panel or the fire alarm system;

performing one or more calculations based on the first, second, and third inputs and the one or more additional inputs to generate one or more outputs for determining compliant operation of the power supply panel integrated in the fire alarm system; and automatically providing an alert in the user interface when any of the one or more outputs fall outside a compliant range.

2. The method of claim 1, wherein the first, second, and third inputs and the one or more additional inputs are received in a programmable calculation sheet.

3. The method of claim 2, wherein the programmable calculation sheet comprises mathematical formulas for performing the one or more calculations.

4. The method of claim 1, wherein the one or more additional inputs comprises a fourth input in a fourth selectable field relating to a mode of the power supply panel.

5. The method of claim 1, wherein the one or more additional inputs comprises a fifth input in a fifth selectable field relating to a maximum total current flow associated with the power supply panel.

6. The method of claim 5, wherein the fifth input of the fifth selectable field generates a maximum total current output of the one or more outputs.

7. The method of claim 1, wherein the one or more additional inputs comprises a sixth input in a sixth selectable field related to one or more device types associated with the fire alarm system.

8. The method of claim 1, wherein the one or more additional inputs comprises a seventh set of inputs in a seventh selectable field related to one or more output circuits of the fire alarm system.

9. The method of claim 8, wherein the one or more output circuits of the fire alarm system comprise one or more of the following:

one or more notification appliance circuits;

one or more auxiliary circuits; or one or more trigger circuits.

10. The method of claim 8, wherein the one or more outputs comprises a total current draw value associated with the one or more output circuits of the fire alarm system.

11. The method of claim 8, wherein the one or more outputs comprises a voltage drop value associated with the one or more output circuits of the fire alarm system.

12. The method of claim 8, wherein the one or more outputs comprises a compliance status associated with the one or more output circuits of the fire alarm system.

13. The method of claim 1, wherein the one or more outputs is associated with a standby capacity of the fire alarm system.

14. The method of claim 13, wherein the standby capacity is used to calculate a total standby power of the fire alarm system.

15. The method of claim 1, wherein the one or more outputs is associated with an alarm capacity of the fire alarm system.

16. The method of claim 15, wherein the alarm capacity is used to calculate a total alarm power of the fire alarm system.

17. The method of claim 1, wherein the one or more outputs is associated with a minimum battery size required to maintain code compliance.

18. The method of claim 1, wherein the one or more outputs is associated with a maximum number of devices permitted for integration into the fire alarm system.

19. A system for determining compliant integration of a power supply panel in a fire alarm system, comprising:

one or more processors; and one or more computer-readable non-transitory storage media comprising instructions that, when executed by the one or more processors, cause one or more components of the system to perform operations comprising:

providing a user interface comprising a plurality of selectable fields;

receiving a first input in a first selectable field relating to a manufacturer type of the fire alarm system;

receiving a second input in a second selectable field relating to a circuit class associated with one or more circuits of the fire alarm system;

receiving a third input in a third selectable field relating to an end-of-line resistor size;

receiving one or more additional inputs relating to at least one of the power supply panel or the fire alarm system;

performing one or more calculations based on the first, second, and third inputs and the one or more additional inputs to generate one or more outputs for determining compliant operation of the power supply panel integrated in the fire alarm system; and automatically providing an alert in the user interface when any of the one or more outputs fall outside a compliant range.

20. One or more computer-readable non-transitory storage media embodying instructions for determining compliant integration of a power supply panel in a fire alarm system, wherein the instructions when executed by a processor cause performance of operations comprising:

providing a user interface comprising a plurality of selectable fields;

receiving a first input in a first selectable field relating to a manufacturer type of the fire alarm system;

receiving a second input in a second selectable field relating to a circuit class associated with one or more circuits of the fire alarm system;

receiving a third input in a third selectable field relating to an end-of-line resistor size;

receiving one or more additional inputs relating to at least one of the power supply panel or the fire alarm system;

performing one or more calculations based on the first, second, and third inputs and the one or more additional inputs to generate one or more outputs for determining compliant operation of the power supply panel integrated in the fire alarm system; and automatically providing an alert in the user interface when any of the one or more outputs fall outside a compliant range.

* * * * *